United States Patent [19]

Osawa et al.

[11] Patent Number: 4,935,717

[45] Date of Patent: Jun. 19, 1990

[54] RESISTOR DEVICE FOR CONTROLLING A BLOWER

[75] Inventors: Katsuyoshi Osawa; Shinichi Ohi; Tadahiro Takahashi; Kazuo Noguchi; Kashiwa Kobayashi, all of Konan, Japan

[73] Assignee: Diesel Kiki Co., Ltd., Tokyo, Japan

[21] Appl. No.: 367,709

[22] Filed: Jun. 19, 1989

[30] Foreign Application Priority Data

Jul. 8, 1988 [JP] Japan ..... 63-90603[U]
Aug. 26, 1988 [JP] Japan ..... 63-111926[U]

[51] Int. Cl.[5] ..... H01C 1/08
[52] U.S. Cl. ..... 338/51
[58] Field of Search ..... 338/51, 49, 53, 159, 338/254, 256; 165/185; 219/339; 361/104; 337/107, 102, 297

[56] References Cited

U.S. PATENT DOCUMENTS

| | | | |
|---|---|---|---|
| 2,541,852 | 2/1951 | Zimmer | 338/51 |
| 3,497,859 | 2/1970 | Bang | 338/51 X |
| 3,955,169 | 5/1976 | Kerfoot et al. | 338/51 |

*Primary Examiner*—Bruce A. Reynolds
*Assistant Examiner*—Marvin M. Lateef
*Attorney, Agent, or Firm*—Wenderoth, Lind & Ponack

[57] ABSTRACT

A blower control resistor device includes a plurality of resistors leading to resistor terminals, and a plurality of connecting terminals joined with the resistor terminals by thermal fuses. The joint portions between the resistor terminals and the connector terminals are concealed by a cover or the like so as to prevent an authorized modification of the resistor device. Preferably, one of the thermal fuses which is connected with a connector terminal near a power supply has a lower-melting point than other thermal fuses.

7 Claims, 10 Drawing Sheets

RESISTOR DEVICE FOR CONTROLLING A BLOWER

BACKGROUND OF THE INVENTION

1. Field of the Invention:

The present invention relates to a resistor device for controlling a blower by regulating electric current to be supplied to the blower for adjusting the capacity of the blower.

2. Description of the Prior Art:

In an adjustment of the capacity of an air conditioner, a resistor device is connected between a power supply and a blower motor of a blower for controlling the magnitude of electric current flowing through the blower motor.

The resistor device of the type described includes a plurality of resistors of different resistance values connected in series and selected to vary the magnitude of electric current to be supplied to the blower motor for adjusting the flow rate of the blower. As shown here in FIG. 19 of the accompanying drawings, a blower motor 3 is connected between a power supply 58 and a common terminal 17*b'* of a resistor circuit 9'. The resistor circuit 9' includes a series of resistors 9*a'*, 9*c'* and 9*d'* of different resistance values and connected to terminals 17*a'*, 17*c'* and 17*d'*, respectively. The terminals 17*a'*, 17*c'*, 17*d'* are connected through respective thermal fuses 56' to three connecting terminals 29*a'*, 29*c'*, 29*d'* selected by a switch mechanism 59'. A thermal fuse 56' is connected between the common terminal 17*b'* and the motor 3. One of the connecting terminals 29*a'*, 29*c'* and 29*d'* is selectively connected to the switch mechanism 59' to change the magnitude of a resistance connected in series with the motor 3 to thereby vary the capacity of the motor 3.

When the blower motor 3 is locked under accidental conditions, the resistors 9*a'*, 9*c'*, 9*d'* generate a great amount of heat due to an overcurrent flowing therethrough. When the temperature of the resistors 9*a'*, 9*c'*, 9*e'* reaches to a predetermined value, any of the thermal fuses 56' is fused to break down a circuit, thereby stopping power supply to the motor 3.

Since the thermal fuses are placed at an easily accessible position, the user may inadvertently recover the molten thermal fuse by soldering or replacement with a wire for reactivating the resistor device. With the thermal fuse thus recovered, power supply to the motor is not stopped even when an overcurrent flows through a circuit including the motor and the thermal fuse. As a consequence of this overcurrent, the motor is damaged and the circuit is burnt out which may result in a fire.

The thermal fuses 56' stated above have the same melting temperature regardless of the place where the individual thermal fuse is used, as shown, for example, in Japanese Patent Laid-open Publication No. 63-13808. Since the thermal fuse 56' disposed between the common terminal 17*b'* and the blower motor 3 may be fused in the same manner as the thermal fuses 56' disposed respectively between the resistors 9*a'*, 9*c'*, 9*d'* and the corresponding connecting terminals 29*a'*, 29*c'*, 29*d'*, it is difficult to determine as to which fuse is melted down.

This means that in the case where one of the thermal fuses 56' at a connecting terminal side is melted down by overcurrent while the thermal fuse 56' at a common terminal side is still alive, a circuit may be completed when the switch mechanism 59' is actuated to another combination of the resistors 9*a'*, 9*c'*, 9*d'*. In such a case, the circuit including the blower motor 3 is damaged or otherwise burnt out due to overcurrent, which may result in a fire.

SUMMARY OF THE INVENTION

With the foregoing difficulties in view, an object of the present invention is to provide a blower control resistor device including thermal fuses which are difficult to access by the user.

Another object of the present invention is to provide a resistor device for controlling a blower, which is so constructed as to become inactive when an unauthorized modification is made to a resistor body by the user.

A further object of the present invention is to provide a blower control resistor device which is capable of stopping power supply to a blower motor when resistor circuit is overheated by an overcurrent flowing therethrough.

According to a first aspect of the present invention, there is provided a resistor device for controlling a blower, comprising: a radiation block having a plurality of cooling fins; a resistor circuit including a plurality of resistors, each resistor being connected to one resistor terminal; a support member supporting thereon said radiator block with said resistor circuit disposed therebetween; and a case including a plurality of connector terminals corresponding in number to the number of said resistor terminals and joined with the resistor terminals, respectively, by thermal fuses, said case further including a wall covering respective joint portions between said resistor terminals and said connector terminals, said support member being secured to said case.

Since portions including the thermal fuses are contained in the case and not exposed to the outside, the user cannot modify the thermal fuse portions.

According to a second aspect of the present invention, there is provided a resistor device for controlling a blower, comprising: a resistor circuit including a plurality of series connected resistors and a plurality of terminals extending from opposite ends of the respective resistors, one of said terminals being a common terminal for being connected with a power supply; a plurality of connector terminals for connecting said terminals of said resistor circuit except said one terminal, to an external switch mechanism for selectively grounding said terminals of said resistor circuit except said one terminal; first thermal fuses joining said terminals of said resistor circuit except said common terminal with said connector terminals; and a second thermal fuse joining said common terminal with a connector terminal for being connected with a power supply, said second thermal fuse having a melting point lower than the melting point of said first thermal fuses.

Since the thermal fuse connected to the common terminal has a lower melting point than thermal fuses connected to the resistor terminals other than the common terminal, the first-mentioned thermal fuse is melted down prior to the melting of the latter-mentioned thermal fuses when heat is generated from the resistors due to an overcurrent flowing through the resistor circuit at a time of failure of the blower motor. Thus, the blower motor is separated from the power supply reliably.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

The present invention will be described hereinbelow in greater detail with reference to certain preferred embodiments shown in the accompanying drawings.

Figure 8:
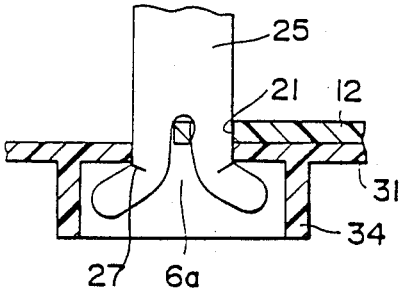
FIGS. 8 and 9 are cross-sectional views illustrative of the operation of the leg shown in FIG. 7.
Figure 9:
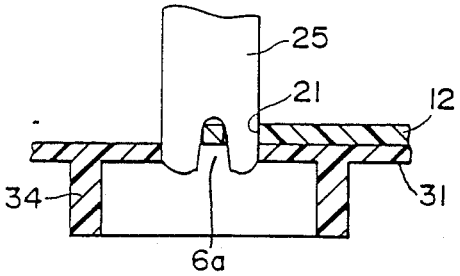
Figure 10:
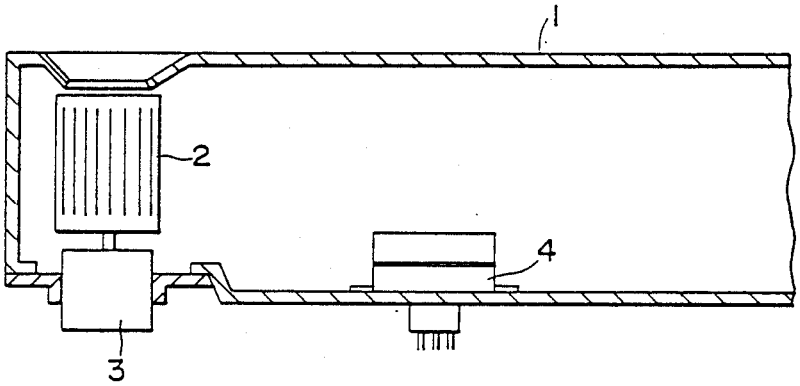
FIG. 10 is a cross-sectional view of a airflow duct in which the resistor device shown in FIG. 1 is disposed.

FIGS. 1 through 10 illustrate a first embodiment of the present invention. As shown in FIG. 10, an airflow duct 1 of an automobile air conditioner contains a fan or blower 2 driven by a motor 3, and a resistor device 4 disposed downstream of the fan 2 and electrically connected to the motor 3 for controlling the operation of the motor 3. The resistor device 4 thus disposed is cooled by air flowing through the airflow duct 1.

The resistor device 4 serves to change the magnitude of an electric current supplied to the motor to vary the flow rate of discharge air stepwise between low level, a middle low level, a middle high level and a high level.

Figure 1:
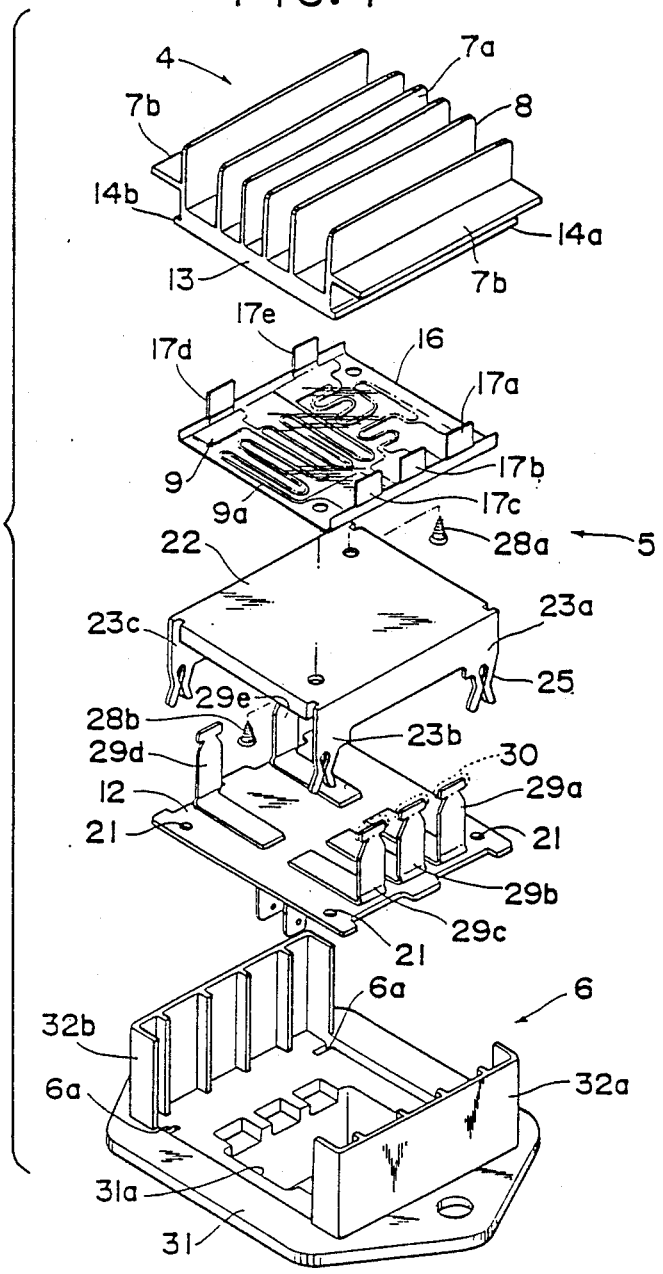
FIG. 1 is an exploded perspective view of a resistor device according to a first embodiment of the present invention.

The resistor device 4, as shown in FIG. 1, includes a resistor body 5 and a case 6 receiving therein the resistor body 5 for protecting the same.

The resistor body 5 includes an air cooled radiation block 8, a resistor circuit 9, a support member 22 for the radiation block 8, and a support plate 12 for connector terminals, the components 8, 9, 22 and 12 being overlied one on another in the order described.

The radiation block 8 includes a planar base 13 and a plurality of cooling fins 7a, 7b integrally formed on an upper surface of the base 13. The cooling fins 7a project vertically outwardly from the upper surface of the base 13 while the cooling fins 7b project horizontally outwardly from two outermost ones of the vertical cooling fins 7a.

Figure 3:
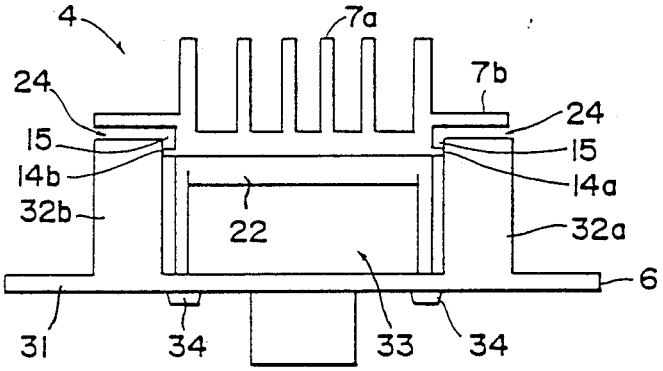
FIG. 3 is a front elevational view of the resistor device.

The base 13 has a pair of lateral spacers 14a, 14b extending along opposite side edges of the base 13 and projecting parallel in directions parallel to the horizontal cooling fins 7b. The spacers 14a, 14b serve to provide a pair of spaces 15, respectively, between the base 13 and the case 6 when the base 13 is received in the case 6, as shown in FIG. 3.

The resistor circuit 9 includes a continuous resistor 9a extending in meandering or zigzag pattern, and a pair of insulating papers 16 covering opposite surfaces of the resistor circuit 9. The resistor circuit 9 is held in contact with the radiation block 3 with an upper one of the insulating papers 16 disposed therebetween. The resistor circuit 9 is formed by etching on a copper-nickel alloy board or a iron-chromium alloy board and hence is relatively resistant to deformation. The resistor circuit 9 thus constructed can be set in an assembled condition with utmost ease and is unlikely to bend or deform during use. The insulating papers 16 are made of polyimide and bonded with the resistor circuit 9 by an adhesive. The resistor circuit 9 has a plurality (five in the illustrated embodiment) of upstanding connector terminals 17a to 17e leading out from respective portions of the resistor circuit 9, the connector terminals 17a–17e being disposed adjacent to opposite side edges of the board of the resistor circuit 9.

Three 17a, 17b, 17c of the connector terminals 17a–17e are disposed at one side of the resistor circuit 9 while the reminder 17d, 17e are disposed at the other side of the resistor circuit 9. The connector terminal 17b which is disposed centrally between the connector terminals 17a and 17c in FIG. 1 is a common resistor terminal always connected to a power supply. The terminal 17a is a resistor terminal for the high power output, the terminal 17c is a resistor terminal for the low power output, the terminal 17d is a resistor terminal for the middle low power output, and the terminal 17e is a resistor terminal for the middle high output.

The support member 22 for the radiation block 8 is made of metal and has a generally rectangular table-like shape. The table-like support member 22 supports on its upper surface the resistor circuit 9 and secured to the radiation block 8 with the resistor circuit 9 sandwiched therebetween. The support member 22 has two pairs of downwardly bent legs 23a, 23b, 23c, 23d disposed at opposite side edges of the support member 22 adjacent to the corners thereof. The legs 23a–23d have a predetermined length such that in an assembled condition, the radiation block 8 is supported by the support member 22 with the horizontal cooling fins 7b spaced upwardly from the case 6 by a distance 24, as shown in FIG. 3.

Figure 6:
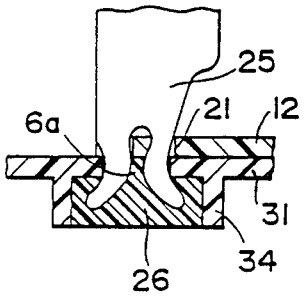
FIG. 6 is an enlarged cross-sectional view of a portion of the resistor device.

Each of the legs 23a–23d has a bifurcated lower end 25 which engages the support plate 12 with one foot of the bifurcated leg end extending through a hole 21 formed in the support plate 12, as shown in FIG. 6. The bifurcated lower end 25 of the leg 23a–23d further extends through a locking hole 6a formed in a body 31 of the case 6 and then is clinched with the case body 31 by spreading the bifurcated lower end 25. The case 6 preferably includes a socket 34 for receiving therein the clinched bifurcated lower end 25. The socket 34 is filled with a synthetic resin material 26 to lock the bifurcated lower end 25 in position against removal from the case body 31.

Figure 7:
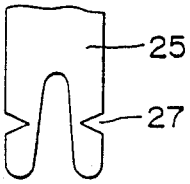
FIG. 7 is a front elevational view of a bifurcated lower end of a leg to be staked to a case of the resistor device.

The bifurcated lower end 25 may be modified as shown in FIGS. 7 to 9. The modified bifurcated lower end 25 has a pair of notches 27 (FIG. 7) formed in the respective feet at proper positions which correspond in position to the lower surface of the case body 31. The notches 27 facilitate bending of the respective feet of the bifurcated lower end 25 when the lower end 25 is clinched to the case body 31, as shown in FIG. 8. Furthermore, the feet of the notched bifurcated lower end 25 are broken when the support member 22 for the radiation block 8 is pulled to remove the lower end 25 from the case body 31, as shown in FIG. 9. With the notched lower end 25 of each leg 23*a*–23*d*, the resistor device 4 cannot be assembled again once the support member 22 is disassembled from the case body 31 for modification.

The support member 22, the resistor circuit 9 and the radiation block 8 are secured together by a pair of screws 28*a*, 28*b* threaded from the underside of the support member 22. The screws 28*a*, 28*b* thus threaded are not exposed to the outside of the resistor device and hence cannot be removed once the resistor device is assembled.

The support plate 12 has five connector terminals 29*a* to 29*e* upstanding from positions corresponding to the respective positions of the connector terminals 17*a*–17*e* of the resistor circuit 9. The connector terminals 29*a*–29*e* are connected with the connector terminals 17*a*–17*e* by thermal fuses 30.

Figure 2:
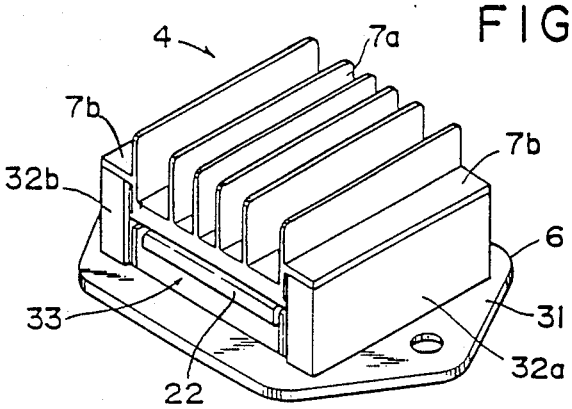
FIG. 2 is a perspective view of the resistor device.

The case 6 includes a pair of confronting vertical walls 32*a*, 32*b* disposed on the base body 31 for covering the thermal fuses 30. The case body 31 has a central opening 31*a* through which one end of the connector terminals 20*a*–20*e* extend. When the resistor device is in the assembled condition, there is provided between the support plate 22 and the case body 31 a space 33 through which air flows to cool the resistor device, as shown in FIGS. 2 and 3.

The case body 31 includes the socket 34 stated above for receiving the lower ends 25 of the respective legs 23*a*–23*d* when the support member 22 is clinched to the case body 31.

With the resistor device 4 of the foregoing construction, the thermal fuses 30 located adjacent to the side edges of the base 13 are accommodated in the spaces defined between the confronting walls 32*a*, 32*b* of the case 6 and the horizontal cooling fins 7*b*, 7*b* so that the thermal fuses 30 are not accessible from the outside of the resistor device 4.

Since the radiation block 8, the resistor circuit 9 and the support member 22 are jointed together by the screws which are not exposed to the outside of the resistor device 4, a disassembling of the resistor device 4 is not easily possible.

Furthermore, the horizontal fins 7*b* on the radiation block 8 serve to cover the thermal fuses 30 disposed in the case 6. Accordingly, the thermal fuses 30 can be concealed without the necessity of a separate cover member.

Further, there are defined between the vertical walls 32*a*, 32*b* and the fins 7*b*, L-shaped spaces 15, 24 for the passage of air, as shown in FIG. 3. The spaces 15, 24 thus provided improve the cooling efficiency of the thermal fuses 30.

The table-like support member 22 provides the space 33 disposed below the radiation block 8, so that air can be ventilated smoothly, thereby prevent condensation of heat within the resistor device 4. Furthermore, the spacers 14*a*, 14*b* serve to separate the thermal fuses 30 from the radiation block 8, as shown in FIG. 4.

Figure 4:
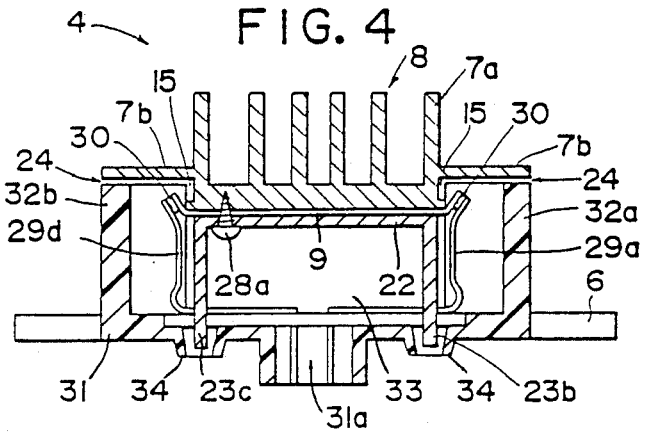
FIG. 4 is a cross-sectional view of the resistor device.
Figure 5:
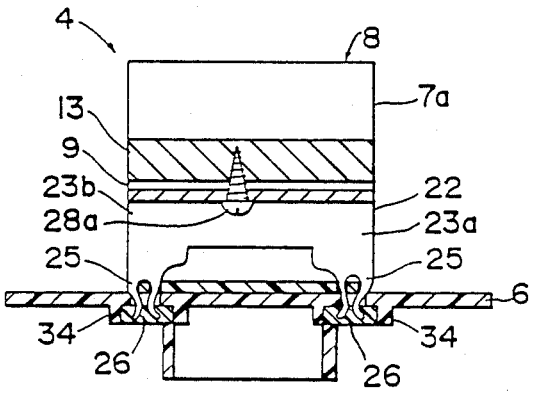
FIG. 5 is a longitudinal cross-sectional view of the resistor.

For purposes of illustration, the spacers 14*a*, 14*b* engage the base portions of the respective resistor terminals 17*a*–17*e* in FIG. 4. However, in reality, the spacers 14*a*, 14*b* are separated from the resistor terminals 17*a*–17*e* by the insulating paper 16 (FIG. 1) with the result that an insulation failure such as short-circuiting does not occur.

Figure 12:
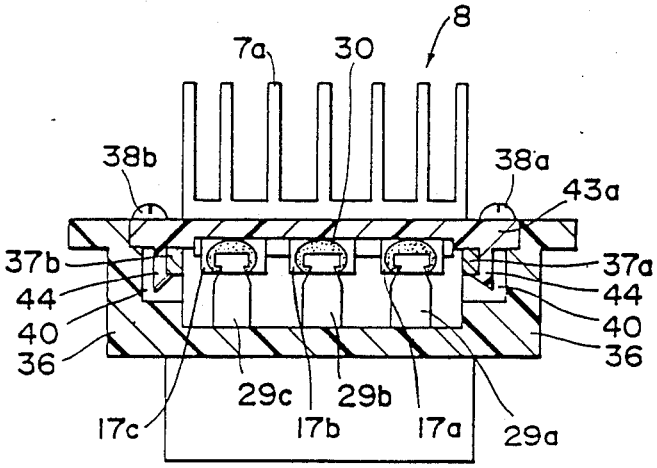
FIG. 12 is a cross-sectional view of the resistor device shown in FIG. 11.

A second embodiment of the present invention will be described below with reference to FIGS. 11 and 12. These parts which correspond to those parts as described with respect to the first embodiment are designated by the same reference characters and hence a detailed description is no longer necessary.

Figure 11:
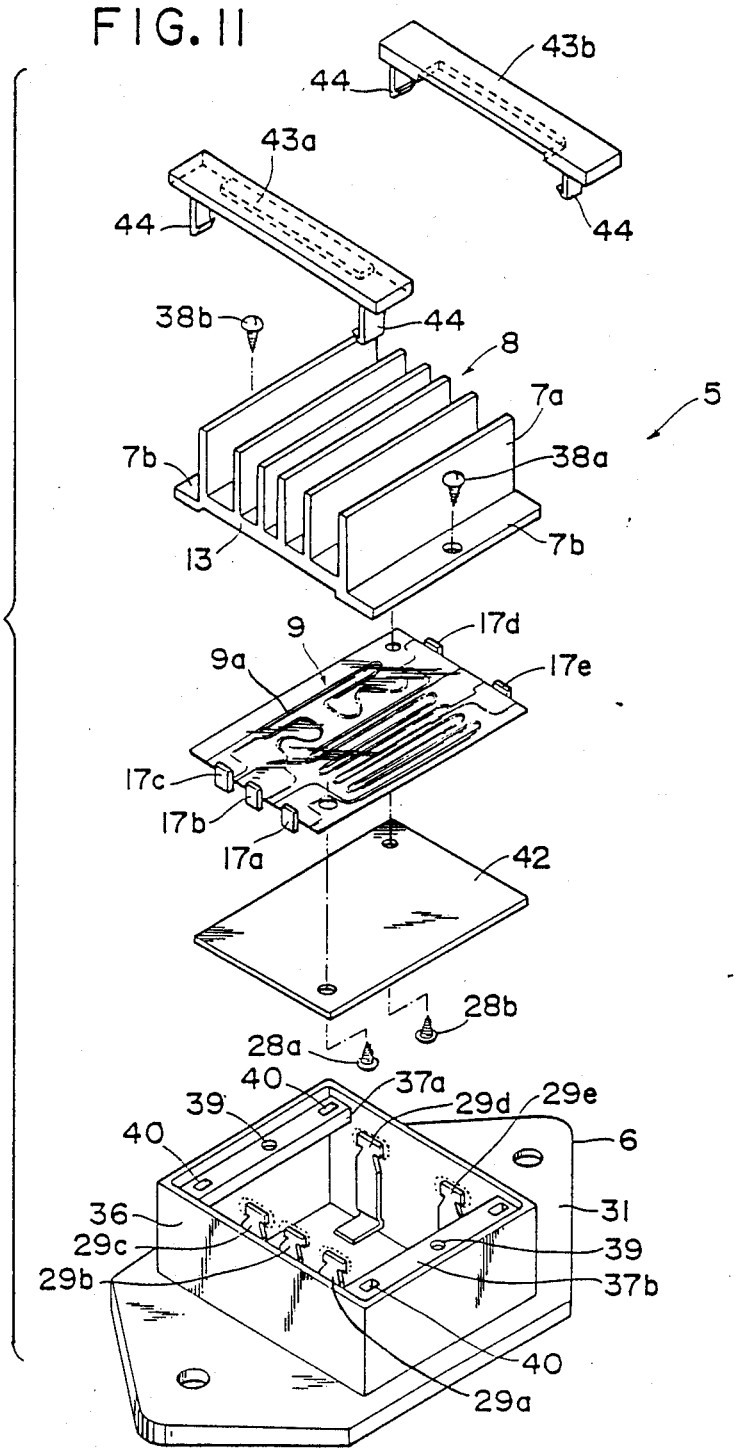
FIG. 11 is an exploded perspective view of a resistor device according to a second embodiment of the present invention.

As shown in FIG. 11, a resistor device according to this embodiment includes a case 6 of a rectangular box-shape having four side walls 36 and a pair of horizontal support bars 37*a*, 37*b* disposed on a pair of confronting side walls 36 for supporting thereon a radiation block 8. To the underside of the radiation block 8, a resistor circuit 9 and a mounting plate 42 are disposed one on above another and attached by means of a pair of screws 28*a*. 28*b* which are threaded from the underside of the mounting plate 42. The radiation block 8 has a pair of horizontal fins 7*b* secured to the support bars 37*a*, 37*b* by means of a pair of screws 38*a*, 38*b* threaded into threaded holes in the support bars 37*a*, 37*b*. Each of the support bars 37*a*, 37*b* has a pair of locking holes 40 into which a pair of locking legs 44 on a cover 43*a*, 43*b* snappingly fit.

The resistor circuit 9 includes a plurality (five in the illustrated embodiment) of resistor terminals 17*a*–17*e* projecting upwardly from front and rear edges of a planar base 13 of the radiation block 8. The resistor terminals 17*a*–17*e* are connected with connector terminals 29*a*–29*e* by thermal fuses 30.

The covers 43*a*, 43*b* are disposed on the front and rear sides of the radiation block 8 and the locking legs 44 on the respective covers 43*a*, 43*b* have a shape which is able to prevent the legs 44 from being removed from the locking holes 40 after the legs 44 are snapped in the corresponding holes 40.

According to the second embodiment described above, attachment of the covers 43*a*, 43*b* to the case6 can be achieved easily only by forcing the covers 43*a*, 43*b* against the case 6. The locking legs 44 on the respective covers 43*a*, 43*b* are disposed inside the case so that detachment of the covers 43*a*, 43*b* from the case 6 is substantially impossible after assembly of the resistor device 5. Accordingly, an access to the thermal fuses 30 is completely prevented.

Figure 13:
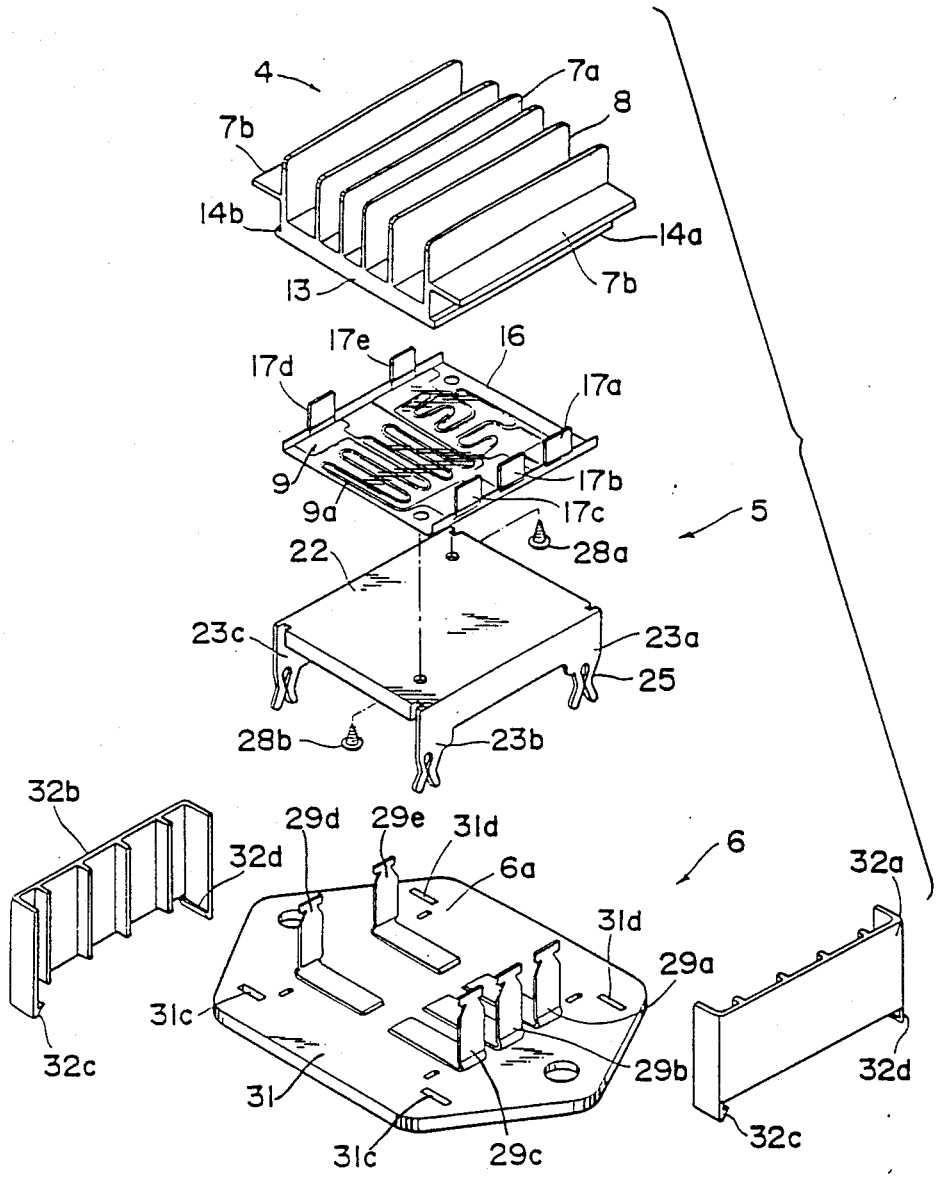
FIG. 13 is an exploded perspective view of a resistor device according to a third embodiment of the present invention.

FIG. 13 illustrates a resistor device according to a third embodiment of the present invention. The resistor device includes a case 6 having tow confronting vertical walls 32*a*, 32*b* which are detachable from a cover body 31. Each of the vertical walls 32*a*, 32*b* has a pair of locking prongs 32*c*, 32*d* lockingly engageable with locking holes 31*c*, 31*d* formed in the case body 31.

The resistor device of this embodiment, as opposed to the resistor device of the first embodiment, does not include a support plate 12 for supporting connector terminals 29a–29e. The connector terminals 29a–29e are disposed directly on the case body 31.

Figure 14:
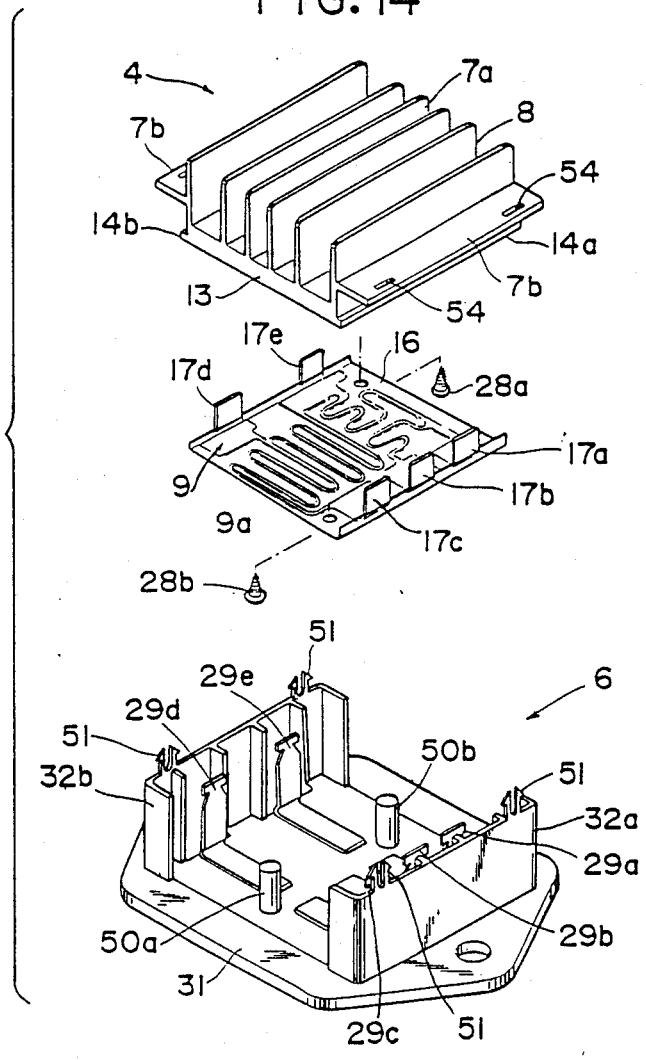
FIG. 14 is an exploded perspective view of a resistor device according to a fourth embodiment of the present invention.

A resistor device according to a fourth embodiment of the invention is illustrated in FIG. 14. The illustrated resistor device is different from the resistor device according to the first embodiment in that a support member for supporting a radiation block 8 is devoid of. A resistor circuit 9 covered with insulating papers 16 on its opposite surfaces is attached to the radiation block 8 by a pair of screws 28a, 28b or an adhesive.

A support plate 12 includes a pair of vertical support rods 50a, 50b extending parallel to connecting terminals 29a–29e for vertically separating the radiation block 8 from a planar case body 31 by a predetermined distance.

The case 6 has a pair of confronting vertical walls 32a, 32b each having a vertical locking prongs 51 extending from an upper surface of the respective vertical wall 32a, 32b. The locking prongs 51 are lockingly engageable with locking holes 54 which are formed in horizontal fins 7b on the radiation block 8 to joint the case 6 and the radiation block 8 with the support rods 50a, 50b disposed therebetween. Since the support member for the radiation block 8 is devoid of, the resistor device can be constructed by a small number of components.

Figure 15:
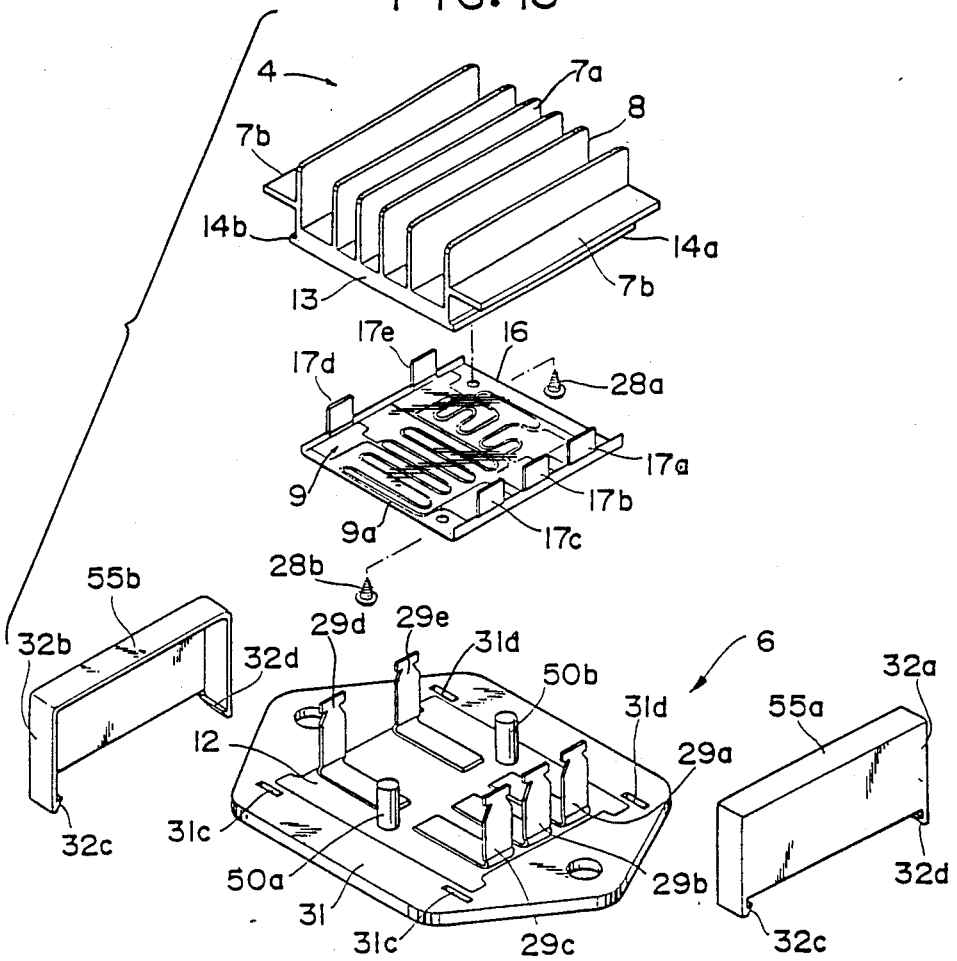
FIG. 15 is an exploded perspective view of a resistor device according to a fifth embodiment of the present invention.
Figure 16:
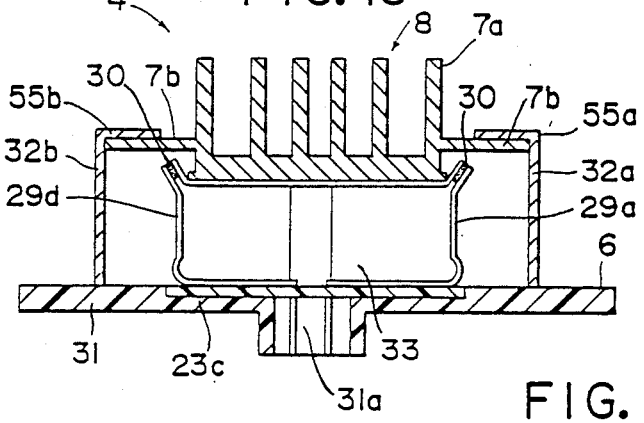
FIG. 16 is a cross-sectional view of the resistor device shown in FIG. 15.

FIGS. 15 and 16 show a resistor device according to a fifth embodiment of the present invention. The resistor device includes a case 6 composed of a body 31 and two confronting vertical walls 32a, 32b which are formed separately from the case body 31. Each of the vertical walls 32a, 32b has a pair of locking prongs 32c, 32d lockingly engageable with corresponding locking holes 31c, 31d formed in the case body 31.

The vertical wall 32a, 32b has a horizontal cover flanges 55a, 55b projecting inwardly from an upper end of the vertical wall portion 32a, 32b. The cover flanges 55a, 55b are laid over horizontal flanges 7b on a radiation block 8 to prevent removal of the radiation block 8 from the case 6, as shown in FIG. 16.

In this embodiment, a supportplate 12 may be formed either separately of the case body 31 or integrally with the case body 31.

Figure 18:
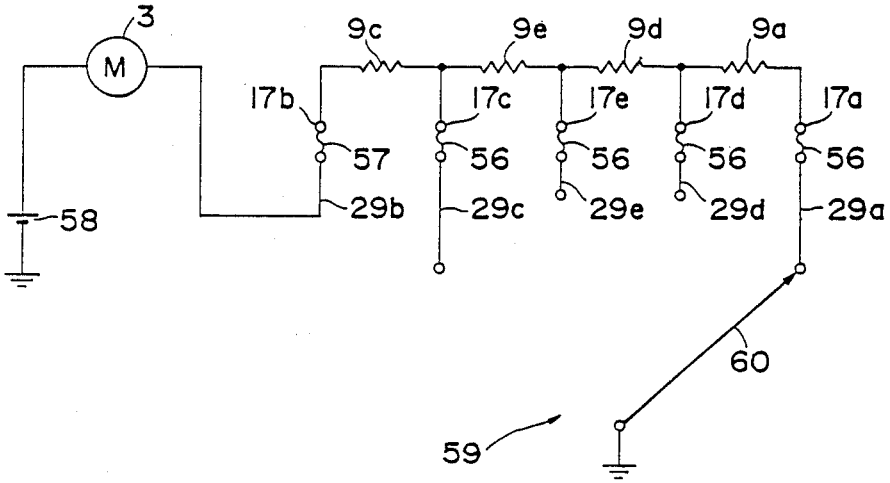
FIG. 18 is a circuit diagram of a resistor device according to the present invention.
Figure 19:
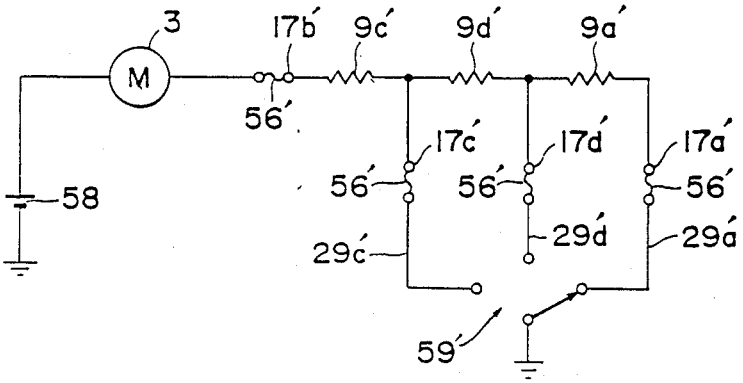
FIG. 19 PRIOR ART
FIG. 19 is a circuit diagram of a conventional resistor device.
Figure 17:
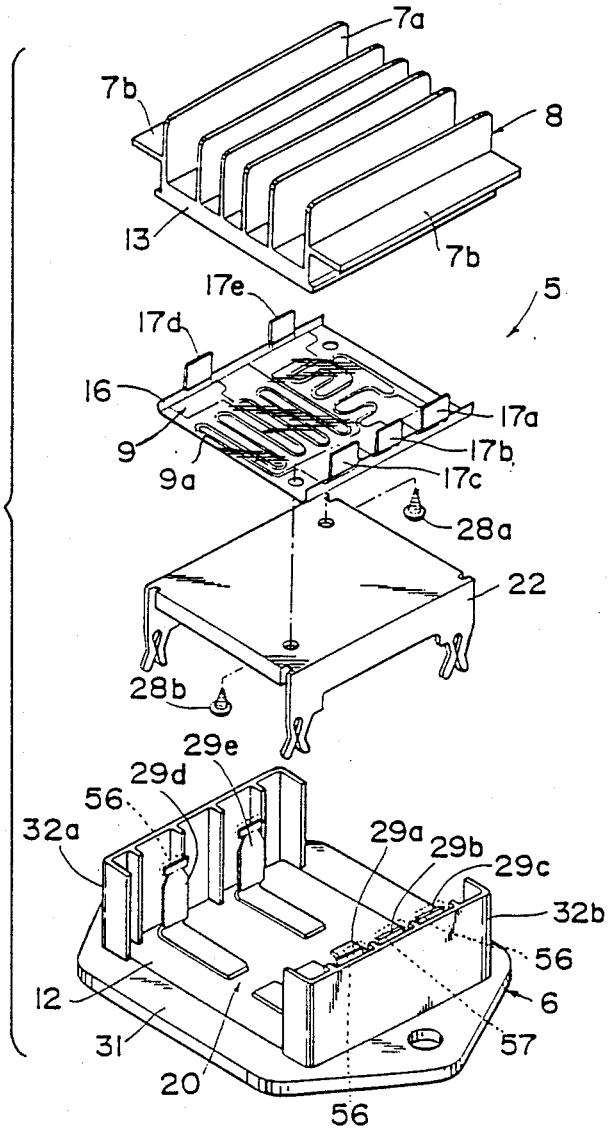
FIG. 17 is an exploded perspective view of a resistor device according to a sixth embodiment of the present invention.

A modified resistor device according to a sixth embodiment of this invention is illustrated in FIGS. 17 and 18. The illustrated resistor device is substantially the same as the resistor device shown in FIG. 1, excepting that thermal fuses 56, 57 of different melting points are used. Resistor terminals 17a, 17d, 17e and 17c and connector terminals 29a, 29d, 29e and 29c are joined together with a first fuse having a melting point, while a common terminal 17b and a connector terminal 29b are joined together with a second fuse 57 having a melting point which is lower than the melting point of the first fuse 56.

FIG. 18 illustrates an electric circuit including an electric motor 3 connected to a power supply 58 and a common terminal 17b of the resistor circuit of the resistor device just described above. The resistor circuit includes four series connected resistors 17a, 17d, 17e and 17c connected respectively to a resistor terminal 17a for the low power output, a resistor terminal 17d for the middle low power output, a resistor terminal 17e for the middle high power output and a resistor terminal 17c for the high power output. The resistor terminals 17a, 17d, 17e and 17c are connected to connector terminals 29a, 29d, 29e and 29c, respectively, via the first thermal fuses 56. The common terminal 17b is connected to the motor 3 by the second thermal fuse 57.

The connector terminal 29a, 29d, 29e and 29c are selectively connected with a switching terminal 60 of a switch mechanism 59 to supply an electric current of varying values to the motor 3.

The melting point of the second thermal fuse 57 is set at about 183° C. while the melting point of the first thermal fuse 56 is set at about 220° C. The melting points of the first and second thermal fuses 56, 57 may be set at various temperatures provided that the molting point of the second thermal fuse 57 is lower than the melting point of the first thermal fuses 56.

When the blower is malfunctioned at the time of starting, the motor 3 is locked and hence air is not led into the airflow duct. The locking of the motor 3 causes an overcurrent to flow through the resistor circuit 9 whereupon the resistors 9a, 9d, 9e, 9c produce undue heat which is transmitted to the first and second thermal fuses 56, 57, respectively, through the resistor terminals 17a, 17d, 17e, 17c and their corresponding connector terminals 29a, 29d, 29e 29c and through the resistor terminal 17b. Since the melting point of the second thermal fuse 57 is lower than the melting point of the first thermal fuses 56, thereby terminating supply of an electric power to the motor 3. The supply of electric power to the motor 3 does not resume even when the operator inadvertently operates the switch mechanism 59 to connect one of the connector terminals 29a, 29d, 29e, 29c with the switching terminal 60. Thus, the motor 3 is disconnected from the power supply 58 reliably when an accident happens.

Obviously, various modifications and variations of the present invention are possible in the light of the above teaching. It is therefore to be understood that within the scope of the appended claims the invention may be practiced.

What is claimed is:

1. A resistor device for controlling a blower, comprising:

(a) a radiation block having a plurality of cooling fins;

(b) a resistor circuit including a plurality of resistors, each resistor being connected to one resistor terminal;

(c) a support member supporting thereon said radiator block with said resistor circuit disposed therebetween; and (d) a case including a plurality of connector terminals corresponding in number to the number of said resistor terminals and joined with the resistor terminals, respectively, by thermal fuses, said case further including a wall covering respective joint portions between said resistor terminals and said connector terminals, said support member being secured to said case.

2. A resistor device according to claim 1, said support member having a leg clinched to said case, said leg having a notch at an intermediate portion thereof.

3. A resistor device according to claim 1, said support member and said case defining therebetween an airflow channel for the passage therethrough of air.

4. A resistor device for controlling a blower, comprising:

(a) a radiation block having a plurality of cooling fins;

(b) a resistor circuit including a plurality of resistors, each resistor being connected to one resistor terminal;

(c) a support member supporting thereon said radiator block with said resistor circuit disposed therebetween;

(d) a case including a plurality of connector terminals corresponding in number to the number of said resistor terminals and joined with the resistor terminals, respectively, by thermal fuses, said support member being secured to said case; and (e) a cover accommodating respective joint portions between said resistor terminals and said connector terminals and having a portion fitted with a portion of said case to connect said cover and said case.

5. A resistor device for controlling a blower, comprising:

(a) a radiation block having a plurality of cooling fins;

(b) a resistor circuit including a plurality of resistors and joined with said radiation block, each resistor being connected to one resistor terminal;

(c) a case including a plurality of connector terminals corresponding in number to the number of said resistor terminals and joined with the resistor terminals, respectively, by thermal fuses; and (d) a cover secured to one of said radiation block and said case and covering respective joint portions between said resistor terminals and said connector terminals.

6. A resistor device for controlling a blower, comprising:

(a) a radiation block having a plurality of cooling fins;

(b) a resistor circuit including a plurality of resistors, each resistor being connected to one resistor terminal; and (c) a case including a plurality of connector terminals corresponding in number to the number of said resistor terminals and joined with the resistor terminals, respectively, by thermal fuses, said case further having a wall covering respective joint portions between said resistor terminals and said connector terminals.

7. A resistor device for controlling a blower, comprising:

(a) a resistor circuit including a plurality of series connected resistors and a plurality of terminals extending from opposite ends of the respective resistors, one of said terminals being a common terminal for being connected with a power supply;

(b) a plurality of connector terminals for connecting said terminals of said resistor circuit except said one terminal, to an external switch mechanism for selectively grounding said terminals of said resistor circuit except said one terminal;

(c) first thermal fuse joining said terminals of said resistor circuit except said common terminal with said connector terminals; and (d) a second thermal fuse joining said common terminal with a connector terminal for being connected with a power supply, said second thermal fuse having a melting point lower than the melting point of said first thermal fuses.

* * * * *